US007383012B2

(12) United States Patent
Sata

(10) Patent No.: US 7,383,012 B2
(45) Date of Patent: Jun. 3, 2008

(54) IMAGE FORMING APPARATUS WITH ENDLESS BELT MOVABLE IN WIDTHWISE DIRECTION

(75) Inventor: Junichi Sata, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 315 days.

(21) Appl. No.: 11/291,925

(22) Filed: Dec. 2, 2005

(65) Prior Publication Data

US 2006/0133869 A1 Jun. 22, 2006

(30) Foreign Application Priority Data

Dec. 10, 2004 (JP) ..... 2004-358410

(51) Int. Cl.
*G03G 15/20* (2006.01)

(52) U.S. Cl. ..... 399/329

(58) Field of Classification Search ..... 399/329, 399/165, 67, 68; 219/216
See application file for complete search history.

(56) References Cited

U.S. PATENT DOCUMENTS 3,726,588 A * 4/1973 Moser ..... 399/165
4,627,702 A * 12/1986 Anderson ..... 399/165
5,027,160 A 6/1991 Okada et al.
5,153,655 A * 10/1992 Suzuki et al. ..... 399/329
5,157,444 A * 10/1992 Mori et al. ..... 399/329
5,235,395 A * 8/1993 Ishiwata ..... 399/329
5,895,153 A * 4/1999 Aslam et al. ..... 399/329

FOREIGN PATENT DOCUMENTS

| | | |
|---|---|---|
| JP | 2-157883 | 6/1990 |
| JP | 3-260682 | 11/1991 |
| JP | 5-238583 | 9/1993 |
| JP | 6-9096 | 1/1994 |
| JP | 10-109776 | 4/1998 |
| JP | 11-65336 | 3/1999 |
| JP | 11-65384 | 3/1999 |

OTHER PUBLICATIONS

Official Letter (English Translation)/Search Report, issued by The Patent Office of the People's Republic of China, on Feb. 1, 2008, in Chinese Application No. 200510022887.5.

* cited by examiner

*Primary Examiner*—Susan S Lee
(74) *Attorney, Agent, or Firm*—Fitzpatrick, Cella, Harper & Scinto

(57) ABSTRACT

An image heating apparatus has an endless belt for heating an image on a recording material in a nip formed with a roller, a steering control portion for swinging the belt in a widthwise direction of the belt; and an anomaly controller for reducing, when the belt is beyond a predetermined swinging range, a pressure between the belt and the roller to return the belt into a predetermined range.

15 Claims, 17 Drawing Sheets

IMAGE FORMING APPARATUS WITH ENDLESS BELT MOVABLE IN WIDTHWISE DIRECTION

FIELD OF THE INVENTION AND RELATED ART

The present invention relates to an image heating apparatus which heats an image on recording medium. As examples of an image heating apparatus, a fixing apparatus for fixing an image formed on recording medium with the use of an electrophotographic or electrostatic recording method, and a glossiness adding apparatus for increasing an image in the degree of glossiness by reheating the image having been fixed to recording medium, can be listed. As examples of an apparatus which employs an image heating apparatus, there are a copying machine, a printer, and a facsimileing machine, etc.

As one of the examples of an image forming apparatus in accordance with the prior art, there is a laser beam printer, shown in FIG. 6, which has multiple optical scanning means and four drums.

FIG. 16 is a schematic sectional view of an example of an image forming apparatus (laser beam printer) in accordance with the prior art. This image forming apparatus is provided with four image formation stations Pa', Pb', Pc', and Pd', as image forming means, which are disposed in parallel and tandem in the main assembly of the image forming apparatus, as shown in FIG. 16.

The abovementioned image formation stations Pa', Pb', Pc', and Pd' are the stations for forming images (which hereinafter will be referred to as toner images) of toners of magenta, cyan, yellow, and black colors, respectively, and have photosensitive drums 1*a*', 1*b*', 1*c*', 1*d*', respectively, as image bearing members.

In the adjacencies of each of the photosensitive drums 1*a*', 1*b*', 1*c*', 1*d*', a charging device, a developing apparatus, and a cleaner, listing from the upstream side in terms of the rotational direction of the photosensitive drum 1, are disposed in a manner of surrounding the photosensitive drum 1. Below the space for the photosensitive drums 1*a*', 1*b*', 1*c*', 1*d*', a transfer station is located.

In this image forming apparatus structured as described above, a sheet P of recording medium is fed into the main assembly of the image forming apparatus from a sheet feeder cassette. Then, the sheet P is conveyed through the image formation stations Pa'-Pd'. While the sheet P is conveyed through the Pa'-Pd', the toner images formed on the abovementioned photosensitive drums 1*a*'-1*d*' are sequentially transferred onto the sheet P. After the completion of this toner image transferring step, the sheet P is conveyed to a fixing apparatus 500.

In the fixing apparatus 500, the toner images having been transferred onto the sheet P are fixed to the sheet P by heat and pressure. Thereafter, the sheet P is conveyed to an apparatus for processing the sheets delivered thereto (which hereinafter may be referred to simply as sheet processing apparatus).

Referring to FIG. 17, which shows in detail the fixing apparatus 500, the fixing apparatus 500 comprises a fixation roller 510, a halogen heater 520, and a thermistor 525. The fixation roller 510 is rotated in the direction indicated by an arrow mark A, by an unshown driving force source. It is heated by the halogen heater 520. The fixing apparatus is controlled so that the temperature of the fixation roller 510 is kept at a preset level, based on the temperature level detected by the thermistor 525 disposed in contact with the peripheral surface of the fixation roller 510.

Disposed on the underside of the fixation roller 510 is a belt unit 53. A fixation belt 531, which is an endless belt, is stretched around an entrance roller 532, a separation roller 533, and a steering roller 534, being thereby suspended by them.

The separation roller 533 is formed of a metallic substance such as SUS (stainless steel), and is kept pressed in the direction indicated by an arrow mark SF against the fixation roller 510 with the presence of the fixation belt 531 between the two rollers. The steering roller 534 is structured so that it can be moved in a manner to move one of its lengthwise ends in the direction indicated by an arrow mark B, to correct the positional deviation of the fixation belt 531 in its width direction.

The fixing apparatus 500 is also provided with a pressure pad unit 540, which is between the entrance roller 532 and separation roller. The pressure pad unit 540 is made up of: a base 541 formed of a metallic substance such as SUS; a pressure pad 542 formed of silicon rubber or the like; and a slide sheet 543 formed of PI film or the like. The pressure pad unit 540 is kept pressed in the direction indicated by an arrow mark PF against the fixation roller 510, with the fixing belt 531 sandwiched between the slide sheet 543 of the pressured pad unit 540 and fixation roller 510.

Further, the fixing apparatus 500 is provided with an oil felt 536, which is located between the entrance roller 532 and pressure pad unit 540. The oil felt 536 is impregnated with silicon oil. It coats the inward surface of the fixation belt 531 with the silicon oil to reduce the friction between the fixation belt 531 and the slide sheet 543 of the pressure pad unit 540.

The fixation belt 531 forms a fixation nip W in conjunction with the fixation roller 510, pressure pad unit 540, and separation roller 533. With the employment of the fixation belt 531, the nip width is greater than without it, making it possible to better melt the toner on the sheet P. In other words, the fixing apparatus 500 in this embodiment is very suitably structured as the one for such an image forming apparatus as a color image forming apparatus which uses a relatively large amount of toner.

Also regarding the structure of the fixing apparatus 500, the fixation belt 531 is corrected in positional deviation by the steering roller 534. In this method of correcting the positional deviation of the fixation belt 531, the positional deviation of the fixation belt 531 is corrected in the manner proposed in Japanese Laid-open Patent Application 06-9096. That is, as the positional deviation of the fixation belt 531 is detected by a belt position detecting means, the correction roller (steering roller 534) is pivoted so that one of the lengthwise ends of the correction roller (steering roller 534), toward which the fixation belt 531 has shifted, is moved in the direction to shift the fixation belt 531 back toward the opposite lengthwise end of the correction roller.

However, the employment of this method makes it very difficult for the fixation belt 531 to last as long as the other mechanical components of the fixing apparatus 500.

This is for the following reason. That is, the positional deviation of the fixation belt 531 is attributable to a large number of factors, for example, the state of alignment among the structural components, the physical property values of the materials for the structural components, the operational ambience, the cumulative length of usage of the fixation belt 531 (fixing apparatus 500). It is also attributable to whether the fixing apparatus has just been started up, or is being driven at a constant speed, etc. The positional deviation of the fixation belt 531 is a phenomenon that results from the complicated interaction among these factors. Therefore, there are a large number of issues to be overcome, in order to deal with all of the abovementioned factors. Presently, therefore, it is common practice to determine the lengths of the service lives of the components of the fixing apparatus 500, and replace them with predetermined intervals, in order to ensure that the fixation belt 531 will be corrected in its positional deviation.

Further, the fixing apparatus 500 is designed so that if it becomes impossible to correct the positional deviation of the fixation belt 531 before the service life of the fixation belt 531 expires, this situation is detected, the mechanical operation is instantly ceased, and a warning suggesting the need for component exchange is issued (Japanese Laid-open Patent Application 10-109776).

There are essentially two types of phenomenon related to the anomaly in the fixation belt control in terms of positional deviation: the recurrent phenomenon, that is, the phenomenon that is expected to occur with predictable intervals (phenomenon with higher probability of occurrence), and the non-recurrent phenomenon, that is, the phenomenon that is expected to rarely occur (phenomenon with extremely low probability of occurrence). In the past, not only as the former occurred, but also, as the latter occurred (even though there was virtually no chance that the latter would occur), an image forming apparatus was left in the state in which it was stopped due to the occurrence of the above described phenomenon, until the maintenance operation inclusive of component replacement was carried out by a service person. In other words, even in the case of the latter, in which the belt deviation could be corrected without carrying out the above described maintenance operation, the copying operation had to be suspended by a user until the maintenance operation was carried out.

SUMMARY OF THE INVENTION

The primary object of the present invention is to provide an image heating apparatus which carries out a proper corrective operation if the oscillatory range of its fixation belt widens beyond a preset value.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, one of the preferred embodiments of the present invention will be described in detail with reference to the appended drawings. Incidentally, the dimensions, materials, and shapes of the structural components, and the positional relationship among the structural components, of the apparatuses in this embodiment, are not intended to limit the scope of the present invention. That is, they are to be modified as necessary, according to the structure of an apparatus to which the present invention is applied, and various conditions under which the apparatus is operated.

First, a laser beam printer, as one of the examples of the image forming apparatuses in accordance with the present invention, which employs four drums and multiple optical scanning means will be described.

Figure 14:
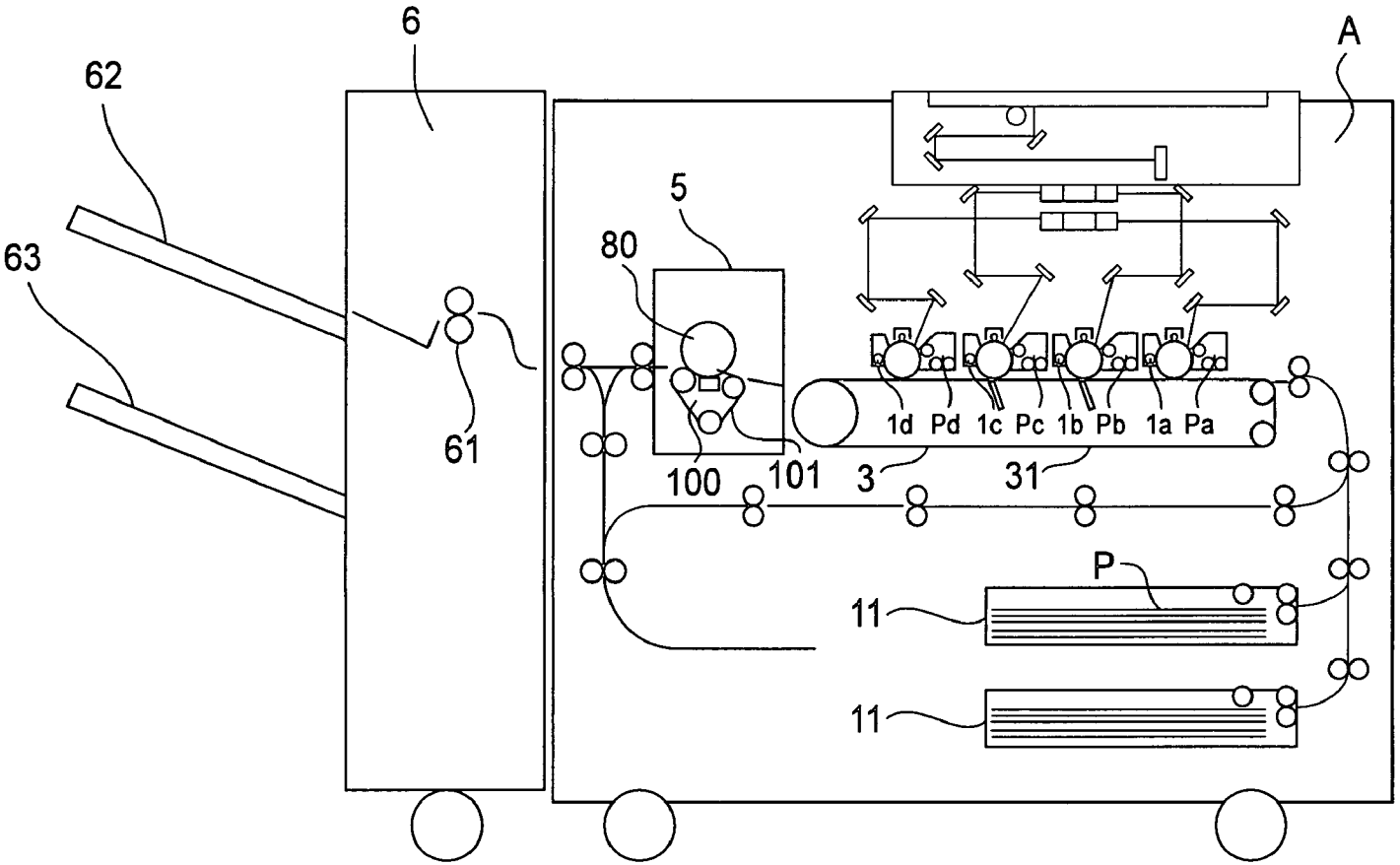
FIG. 14 is a schematic sectional view of the image forming apparatus in the preferred embodiment.
Figure 15:
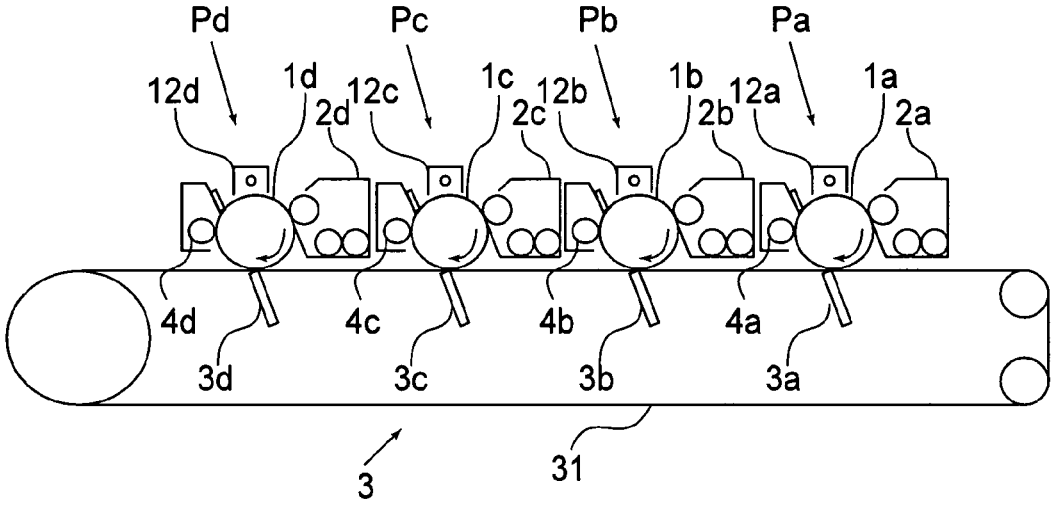
FIG. 15 is a schematic sectional view of the image forming portion of the image forming apparatus in the preferred embodiment.
Figure 16:
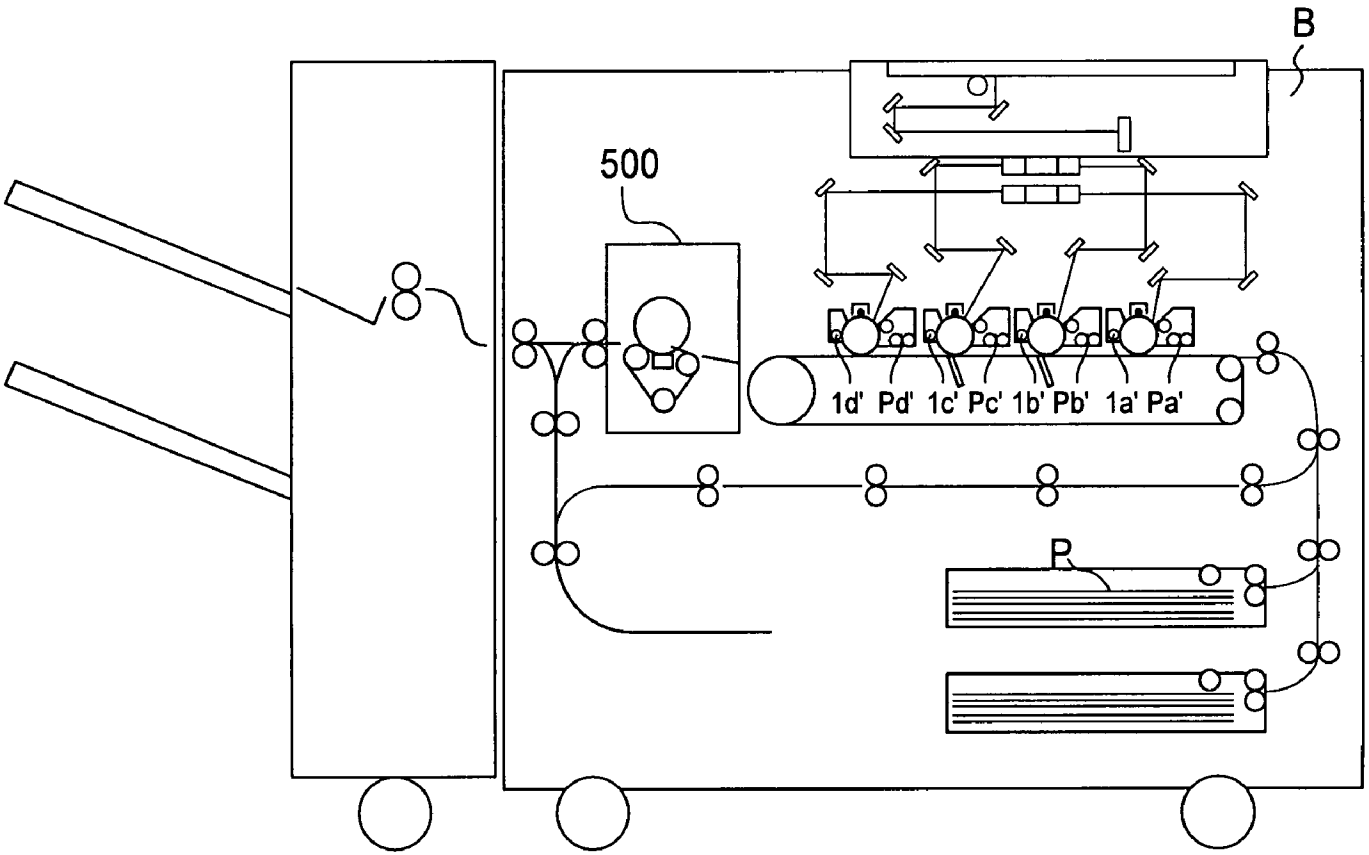
FIG. 16 is a schematic sectional view of one of the typical image forming apparatuses in accordance with the prior art.
Figure 17:
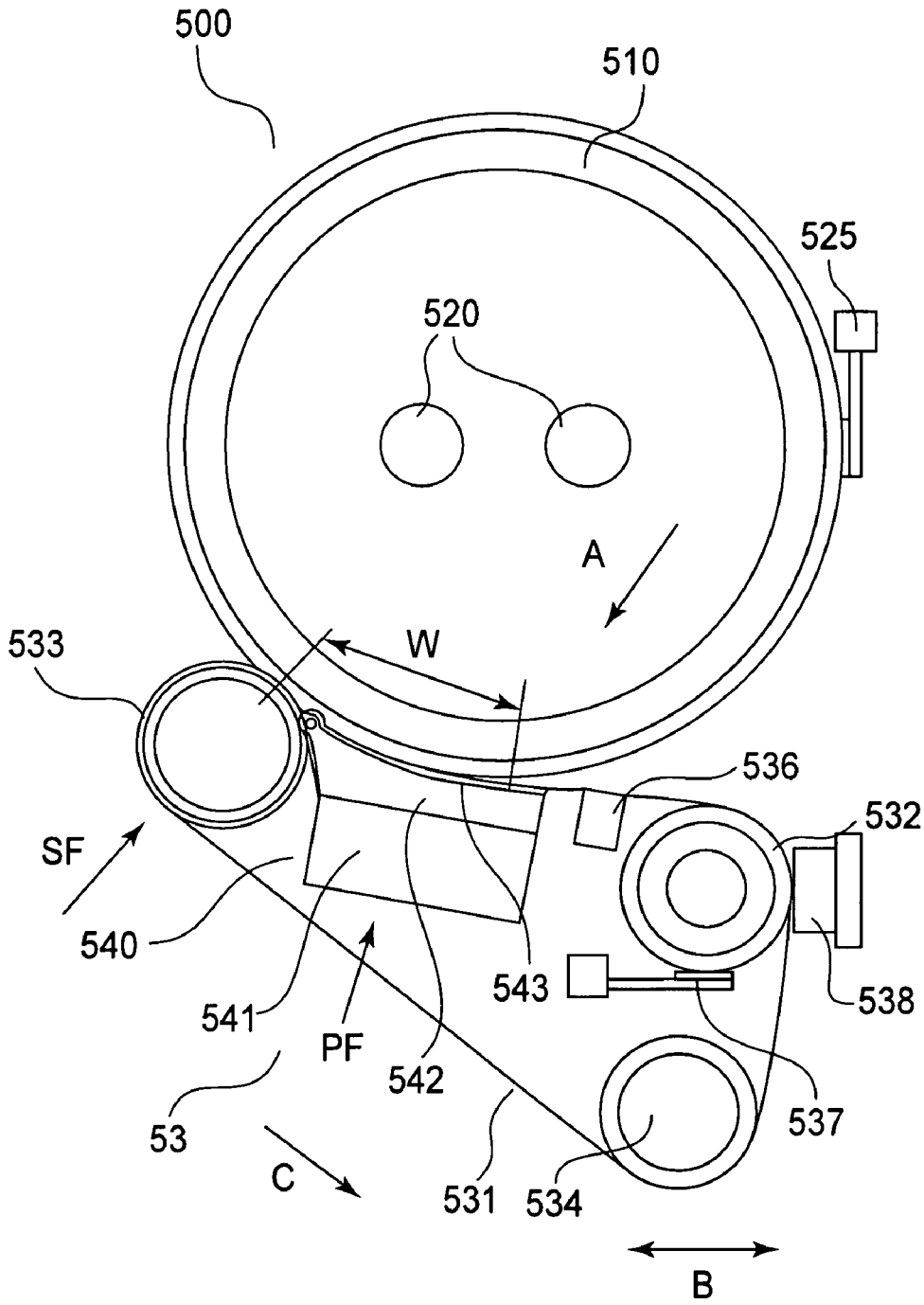
FIG. 17 is a schematic sectional view of one of the fixing apparatuses in accordance with the prior art.

FIG. 14 is a schematic sectional view of the image forming apparatus A (laser beam printer) in this preferred embodiment. FIG. 15 is a schematic sectional view of the image forming portion of the image forming apparatus A in this embodiment. Referring to FIG. 14, the image forming apparatus is provided with four image formation stations Pa, Pb, Pc, and Pd, as image forming means, which are disposed in parallel in the main assembly of the image forming apparatus.

The abovementioned image formation stations Pa, Pb, Pc, and Pd are the stations for forming images of toners of magenta, cyan, yellow, and black colors, respectively. They have photosensitive drums 1*a*, 1*b*, 1*c*, 1*d*, respectively, as image bearing members, which are rotated in the direction indicated by an arrow mark in FIG. 15.

In the adjacencies of the photosensitive drums 1*a*, 1*b*, 1*c*, 1*d*, charging devices 12*a*, 12*b*, 12*c*, and 12*d*, developing apparatuses 2*a*, 2*b*, 2*c*, and 2*d*, and cleaners 4*a*, 4*b*, 4*c*, and 4*d*, listing from the upstream side in terms of the rotational direction of the photosensitive drums 1*a*, 1*b*, 1*c*, and 1*d*, are disposed in a manner of surrounding the photosensitive drums 1*a*, 1*b*, 1*c*, and 1*d*, respectively. Below the space for the photosensitive drums 1*a*, 1*b*, 1*c*, 1*d*, a transfer station 3 is located. The transfer station 3 is has a transfer belt 31 as a recording means conveying means, which is shared by the image formation stations Pa, Pb, Pc, and Pd, and charging devices 3*a*, 3*b*, 3*c*, and 3*d* for transfer.

In this image forming apparatus structured as described above, a sheet P of recording medium is fed into the main assembly of the image forming apparatus from a sheet feeder cassette as a sheet feeding means shown in FIG. 14. Then, the sheet P is placed on the transfer belt 31, and is conveyed through the image formation stations Pa-Pd. While the sheet P is conveyed through the Pa-Pd, the toner images formed on the abovementioned photosensitive drums 1*a*-1*d* are sequentially transferred onto the sheet P. After the completion of this toner image transferring step, the sheet P is separated from the transfer belt 31, and is conveyed to a fixing apparatus 5.

In the fixing apparatus 5, the toner images having been transferred onto the sheet P are fixed to the sheet P by heat and pressure, in the fixation nip. Thereafter, the sheet P is conveyed to a sheet processing apparatus 6. In the sheet processing apparatus 6, the sheet P is discharged by a pair of discharge rollers 61 into a delivery tray 62, which can be moved downward to allow a large number of sheets P to be cumulatively discharged into the delivery tray 62. The sheet processing apparatus 6 is enabled to variously process the sheets P of recording medium, for example, to staple the sheets P.

Next, the fixing apparatus 5 in this embodiment will be described.

The fixing apparatus 5 comprises a fixation roller 80, which is rotatably disposed, and a fixation belt unit 100 disposed below the fixation roller 80.

The fixation roller 80 is rotatably disposed so that it can be rotationally driven by a driving force source. It is heated by a heater disposed in its hollow. The fixing apparatus 5 is controlled so that the temperature of the fixation roller 80 is kept at a preset level, based on the temperature level detected by the thermistor disposed in contact with the peripheral surface of the fixation roller 80.

Next, the fixation belt unit 100 will be described.

Figure 1:
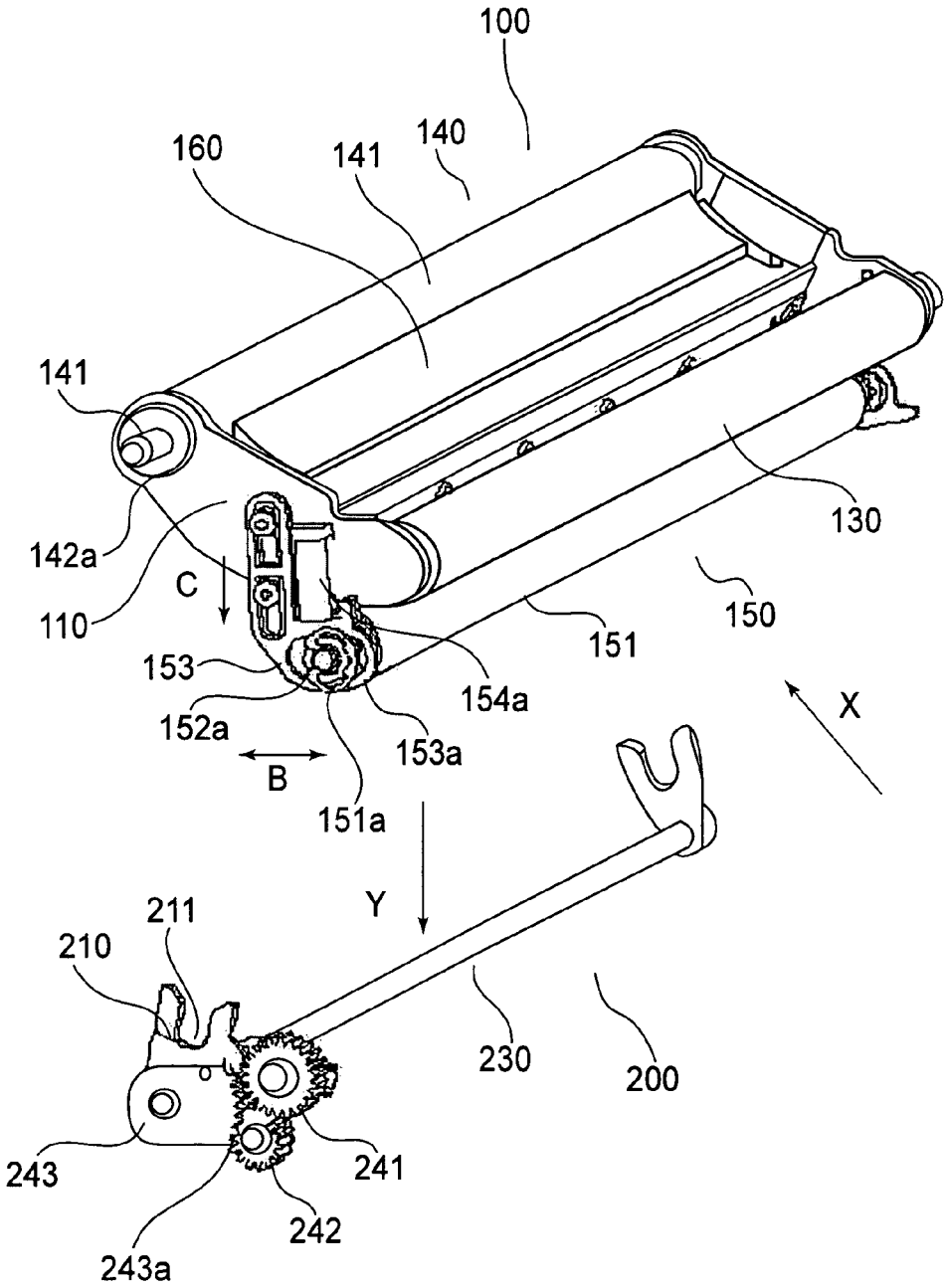
FIG. 1 is a schematic perspective view of the fixation belt unit in one of the preferred embodiments of the present invention.
Figure 2:
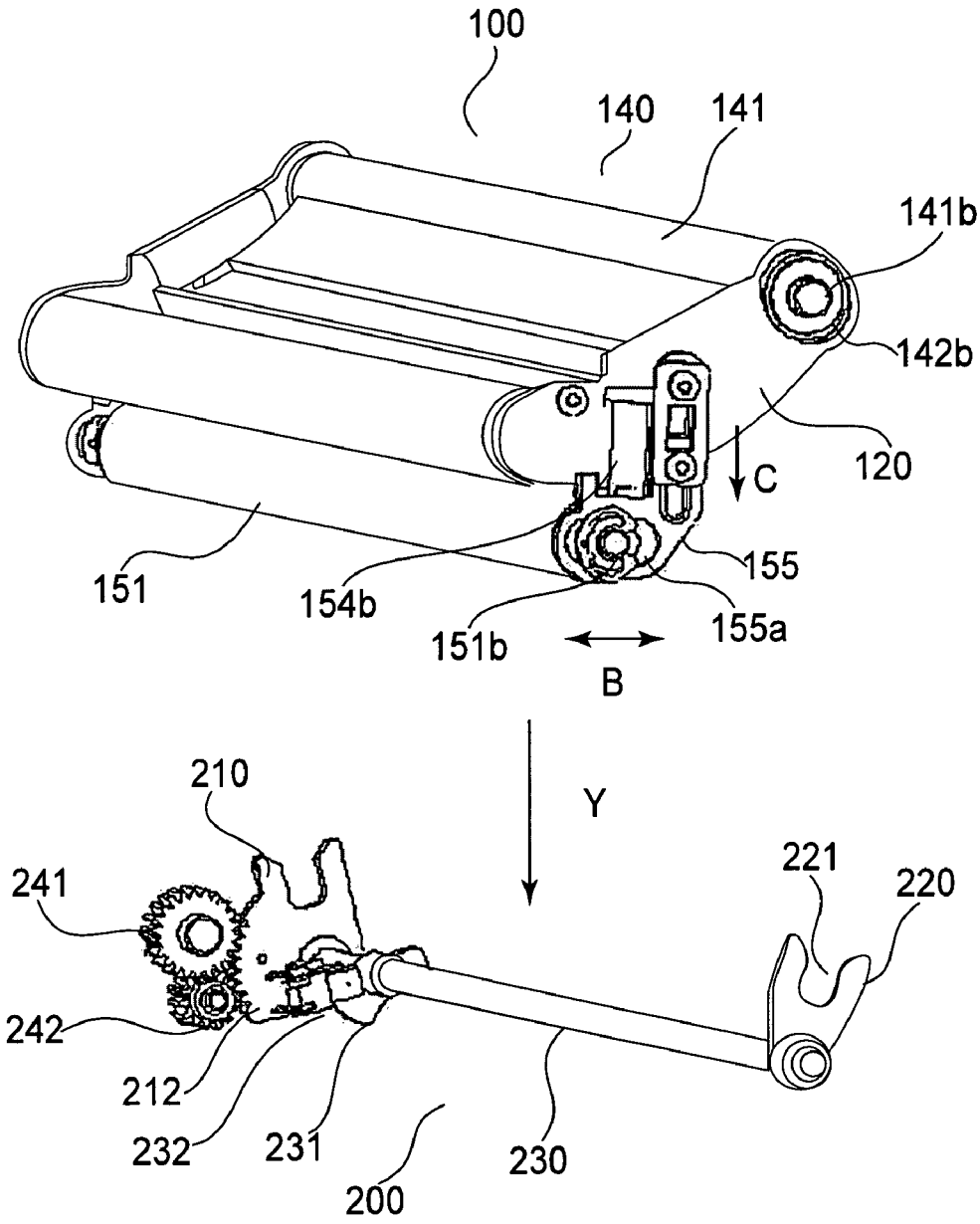
FIG. 2 is also a schematic perspective view of the fixation belt unit in the preferred embodiment.

FIGS. 1 and 2 are schematic drawings of the fixation belt unit 100 (fixation belt 101 is not shown) in this embodiment.

In the fixation belt unit 100, the fixation belt 101 is stretched around multiple rotational members: an inlet roller 130, a separation roller 141, and a steering roller 151, being thereby suspended by them. The fixation belt 101 is kept pressed on the fixation roller 80, forming thereby a fixation nip.

The fixation belt unit 100 is provided with front and rear plates 110 and 120, and a fixation pad portion 160 to which the front and rear plates 110 and 120 are fastened. The inlet roller 13 is rotatably supported by the front and rear plates 110 and 120.

The separation roller portion 140 comprises a separation roller 141, and a pair of bearings 142*a* and 142*b*, which are fitted around the lengthwise end portions 141*a* and 141*b*, respectively, of the separation roller 141. The steering roller portion 150 comprises the steering roller 151, a bearing 152*a* fitted around one of the lengthwise end portions of the steering roller 151, and a pressure application front arm 153 having an elongated hole 153*a* in which the bearing 152*a* is fitted.

The steering roller 151 is movable in the elongated hole 153*a* of the pressure application front arm 153 in the direction indicated by an arrow mark B. Further, the pressure application front arm 153 applies pressure on the steering roller 151 in the direction indicated by an arrow mark C, with the use of a spring 154*a*, tensioning thereby the fixation belt 101.

Similarly on the rear plate side, the other lengthwise end portion 151*b* of the steering roller 151 is fitted with a bearing 152*b*, which is fitted in the elongated hole 155*a* of the pressure application rear arm 155. The steering roller 151 is movable in the elongated hole 155*a* of the pressure application rear arm 155 in the direction indicated by an arrow mark B. Further, the pressure application rear arm 155 applies pressure on the steering roller 151 in the direction indicated by an arrow mark C, with the use of a spring 154*b*, tensioning thereby the fixation belt 101.

A steering control portion 200 as a fixation belt oscillating means is provided with a steering roller supporting front member 210, a steering roller supporting rear member 220, and a control shaft 230 which connects the steering roller supporting front and rear members 210 and 220. More specifically, the steering roller supporting front member 210 is rotatably supported by one of the lengthwise end portions of the control shaft 230, whereas the steering roller supporting rear member 220 is rigidly attached to the other lengthwise end portion of the control shaft 230.

Figure 3:
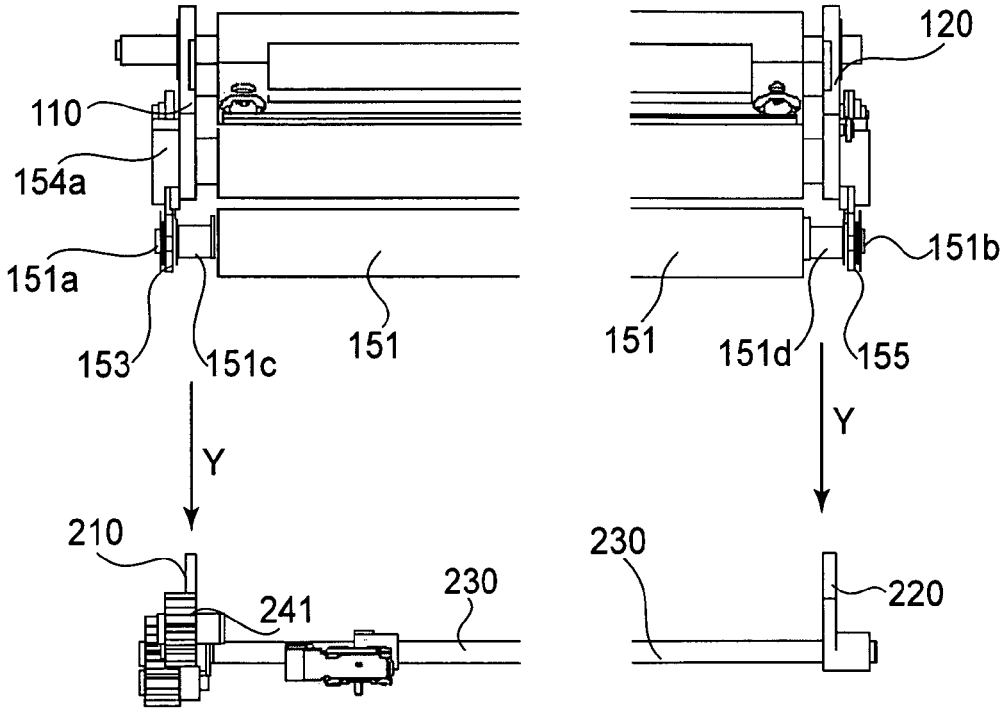
FIG. 3 is a schematic drawing of the fixation belt unit in the preferred embodiment, showing the general structure thereof.

FIG. 3 is a drawing of the fixation belt unit 100 shown in FIG. 1, as seen from the direction indicated by a referential symbol X in FIG. 1.

Referring to FIGS. 1 3, the steering control portion 200, which may serve as swing means, is to be mounted by displacing the fixation belt unit 100 in the direction indicated by an arrow mark Y. As the steering control portion 200 is mounted, the steering control portion accommodating front portion 151*c* of the steering roller 151 fits into the U shaped groove 211 of the steering roller supporting front member 210, and the steering control portion accommodating rear portion 151*d* of the steering roller 151 fits into the U shaped groove 221 of the steering roller supporting rear member 220.

With the provision of the above described structural arrangement, as an input gear 241 is rotated, the steering roller supporting front member 210 is rotated in the opposite direction from the rotational direction of the input gear 241. Further, the control arm 243 is rotated by the rotation of the input gear 241 in the same direction as the rotation direction of the input gear 241, through an idler gear 242. Since the control arm 243 is rigidly attached to the control shaft 230, it rotates the steering roller supporting rear member 220 in the same direction as the rotational direction of the control arm 243. As a result, the steering control portion accommodating front portion 151*c* of the steering roller 151, which is in the U-shaped groove of the steering roller supporting front member 210, and the steering control portion accommodating rear portion 151*d* of the steering roller 151, which is in the U-shaped groove 221 of the steering roller supporting rear member 220, are moved in the opposite directions.

Figure 4:
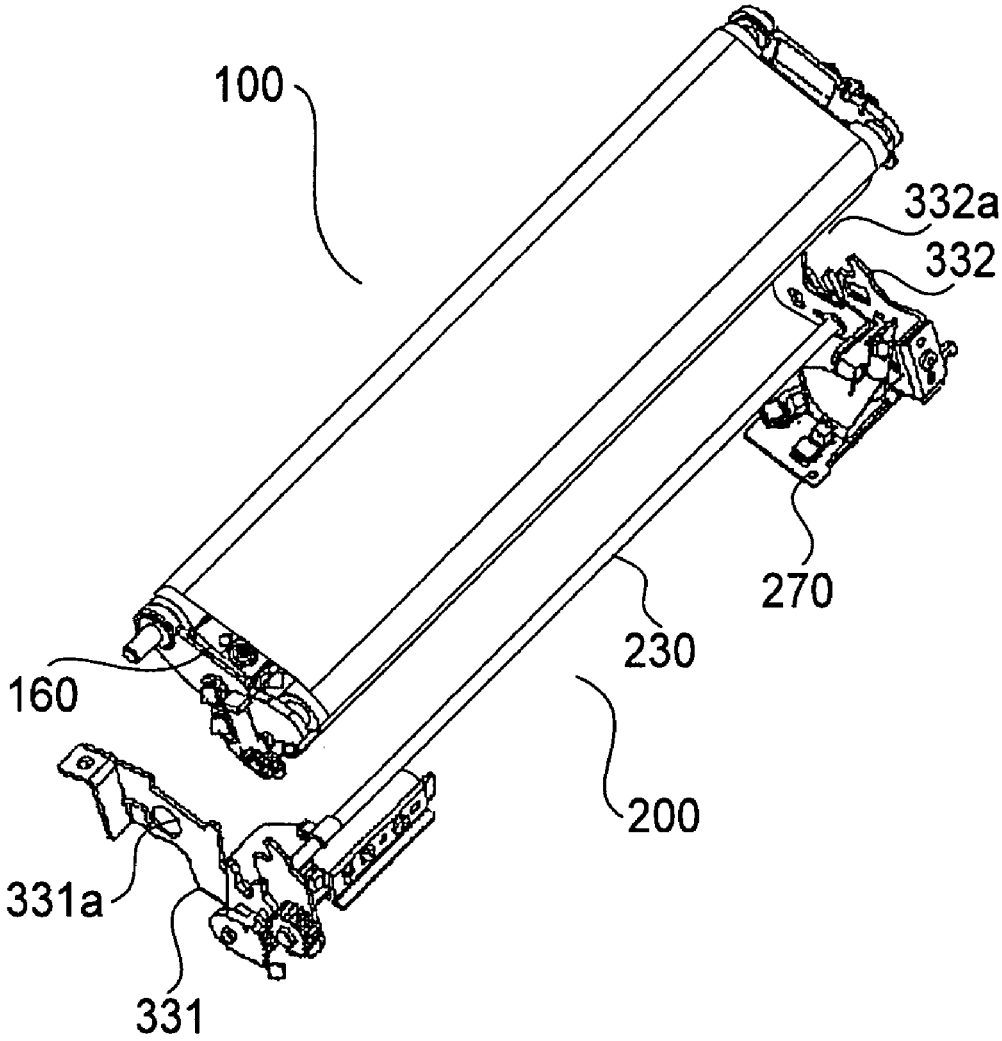
FIG. 4 is a schematic drawing of the fixation belt unit, showing its structural arrangement for pressure application.

FIG. 4 is a drawing of pad pressuring front and rear plates 331 and 332, respectively, which support the fixation belt unit 100.

The fixation pad portion 160 is supported by the fixation pad portion accommodating portion 331*a* of the pad pressuring front plate 331, and the fixation pad accommodating portion 332*a* (which is the same in shape as pad pressuring front plate, and is not shown) of the pad pressuring rear plate 332. Further, the pad pressuring rear plate 332 is provided with a belt deviation detecting portion 270 as a means for detecting the positional deviation of the fixation belt 101 (in terms of the direction parallel to the axial lines of the rollers). The control shaft 230 is rotatably supported by the pad pressuring front and rear plates 331 and 332, with a pair of bearings placed between the lengthwise end portions of the control shaft 230 and the pad pressuring front and rear plates 331 and 332, one for one.

Figure 5:
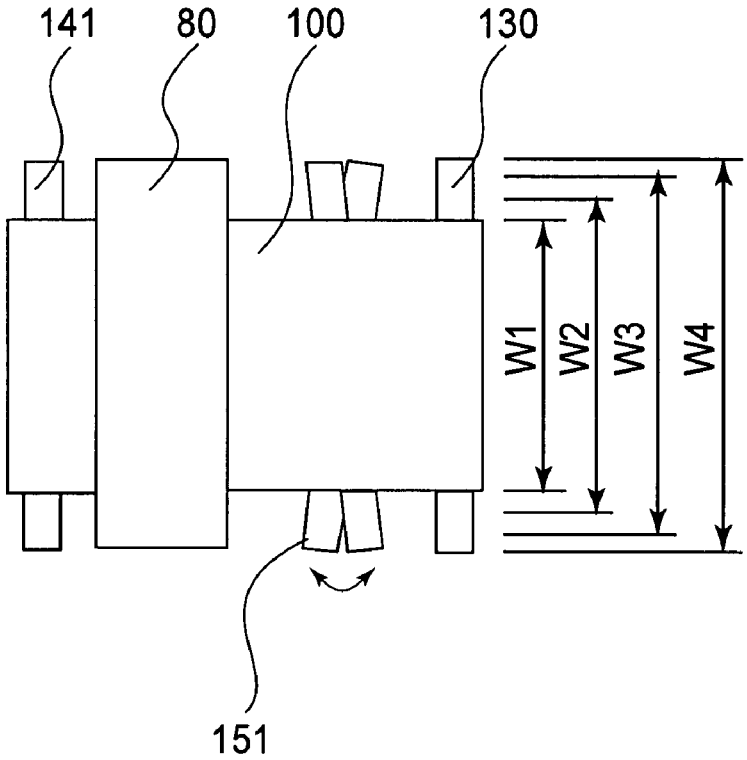
FIG. 5 is a schematic drawing showing the oscillatory ranges of the fixation belt detected by the detecting means, in the preferred embodiment.

FIG. 5 is a drawing showing the extent of the positional deviation of the fixation belt 101, which is detected by the belt deviation detecting portion 270 as a means for detecting the positional deviation of the fixation belt 101. A referential symbol W1 stands for the width of the fixation roller 101, and a referential symbol W2 stands for the normal range with a preset value, in which the fixation is oscillated in its width direction by the changing of the position of the steering roller 151. A referential symbol W3 stands for the abnormal oscillatory range of the fixation belt 101, which is substantially wider than the range W2. A referential symbol W4 stands for the maximum range in which the fixation belt 101 can be oscillated (beyond this range, belt is not rotatable, and forceful rotation of belt results in damage to belt). The abovementioned belt deviation detecting portion 270 is made up of a position sensor capable of detecting the ranges W2 and W3.

Figure 6:
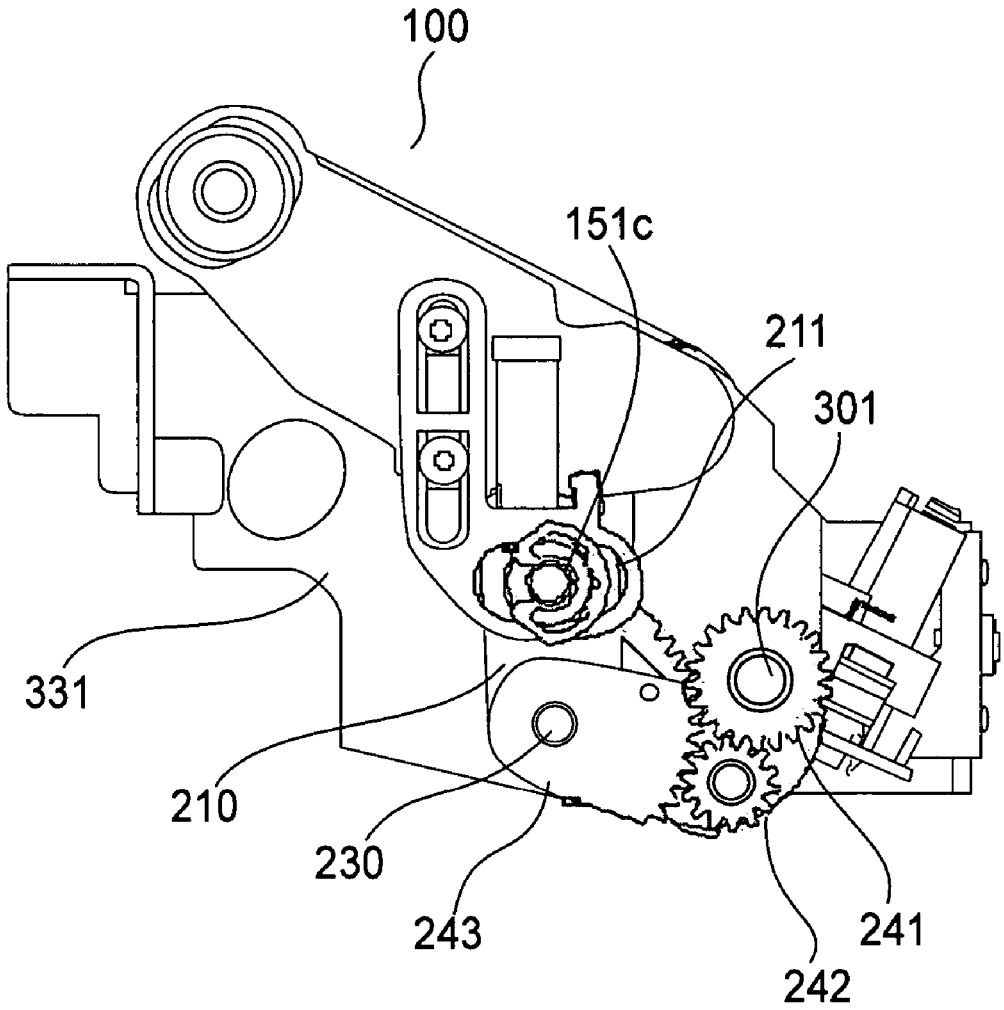
FIG. 6 is a schematic drawing of the fixation belt unit, showing its structural arrangement for pressure application.

FIG. 6 is a side view of the fixation belt unit 100, which has been attached to the pad pressuring front and rear plates 331 and 332, as seen from the front plate side of the fixing apparatus. The steering control portion accommodating front portion 151*c* of the steering roller 151 is in the U-shaped groove 211 of the steering roller supporting front member 210. The control arm 243 is provided with a positioning hole 243*c*, which is similar to the hole with which the steering roller supporting front member 210 is provided, and the hole with which the pad pressuring front plate 331 is provided. By aligning this positioning hole 243*c* of the control arm 243 with the hole of the steering roller supporting front member 210 and the hole of the pad pressuring front plate 331, it is possible to synchronize the steering roller supporting front member 210 and control arm 243 in the phase relative to the pad pressuring front arm 331. Further, the input gear 241 and idler gear 242 are also attached to the pad pressuring front plate 331.

Figure 7:
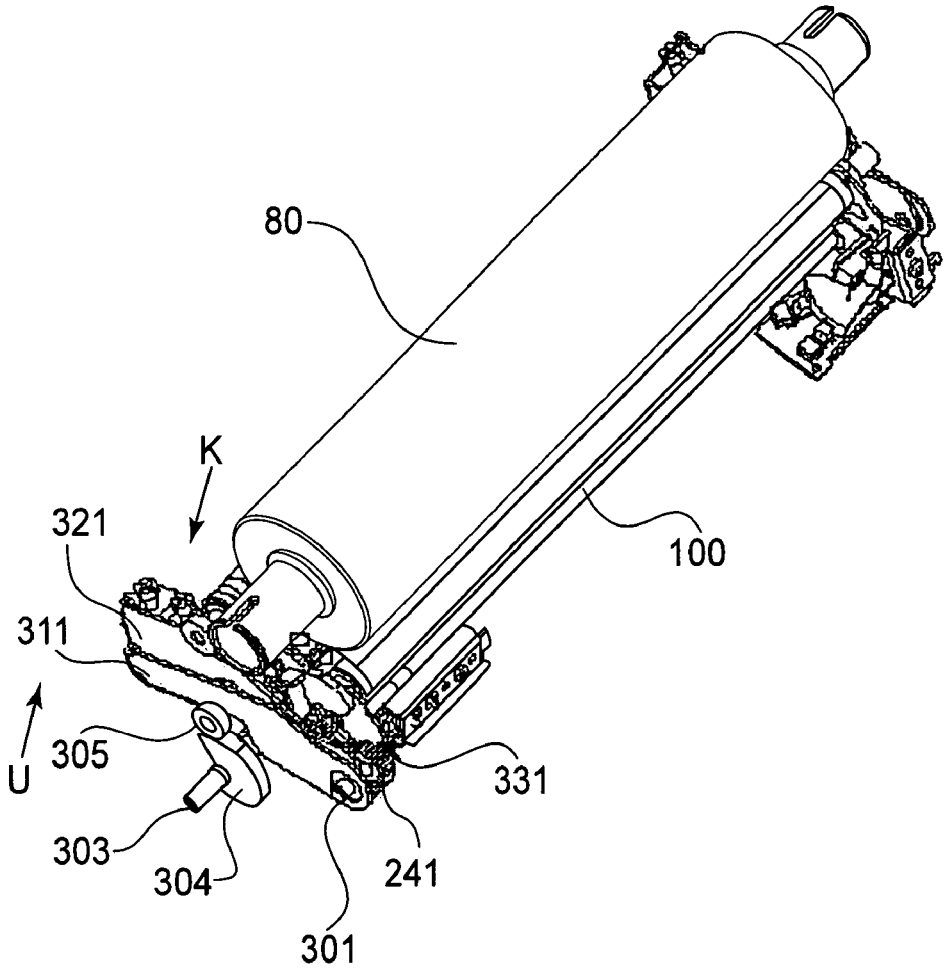
FIG. 7 is a schematic drawing of the fixation belt unit, showing its structural arrangement for pressure application.

FIG. 7 is a drawing of a pressure application mechanism 300 as a fixation belt unit moving means, which is for pressing the fixation belt unit 100 against the fixation roller 80. The pressure application mechanism 300 is provided with a rotational axle 301 attached to an unshown fixating apparatus frame. As a cam 304 rotates about a cam shaft 303, the fixation belt unit 100 is placed in contact with, or moved away from, the fixation roller 80. More specifically, the pressure application mechanism 300 is enabled to take a pressure application position in which it presses the fixation belt unit 100 upon the fixation roller 80, and a position in which it eliminates or reduces the pressure it applied to the fixation belt unit 100. More specifically, as the cam 304 is rotated about the cam shaft 303, the roller 305 of the pressure application front plate 311 is lifted, causing the pressure application mechanism 300 to pivot in the direction indicated by an arrow mark U. As a result, the fixation belt unit 100 is pressed on the fixation roller 80.

Figure 8:
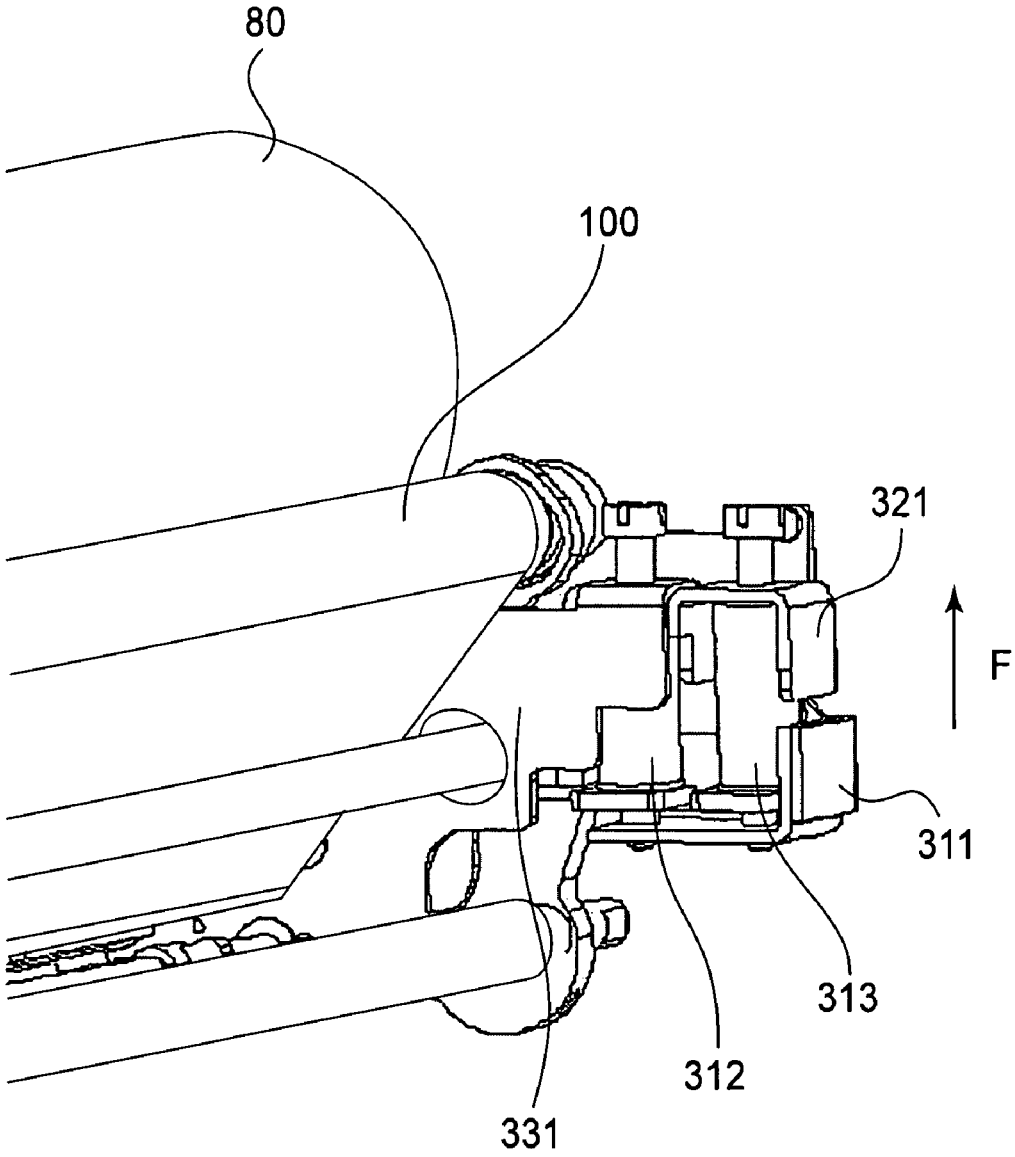
FIG. 8 is a schematic drawing of the fixation belt unit, showing its structural arrangement for pressure application.

FIG. 8 is a drawing of the fixation belt unit 100 and fixation roller 80 shown in FIG. 7, as seen from the direction indicated by an arrow mark K in FIG. 7. The pressure application cam 304 lifts the pressure application front plate 311, which is provided with a pad pressing spring 312 and a pad separating spring 313. The pad pressing spring 312 acts in the direction to lift the pad pressing plate front plate 331 in the direction indicated by an arrow mark F, and the pad separating spring 313 acts in the direction to lift a pad separation front plate 321 in the direction indicated by the arrow mark F. In this case, the structural arrangement on the pad pressing rear plate side is the same as that on the pad pressing front plate side.

Figure 9:
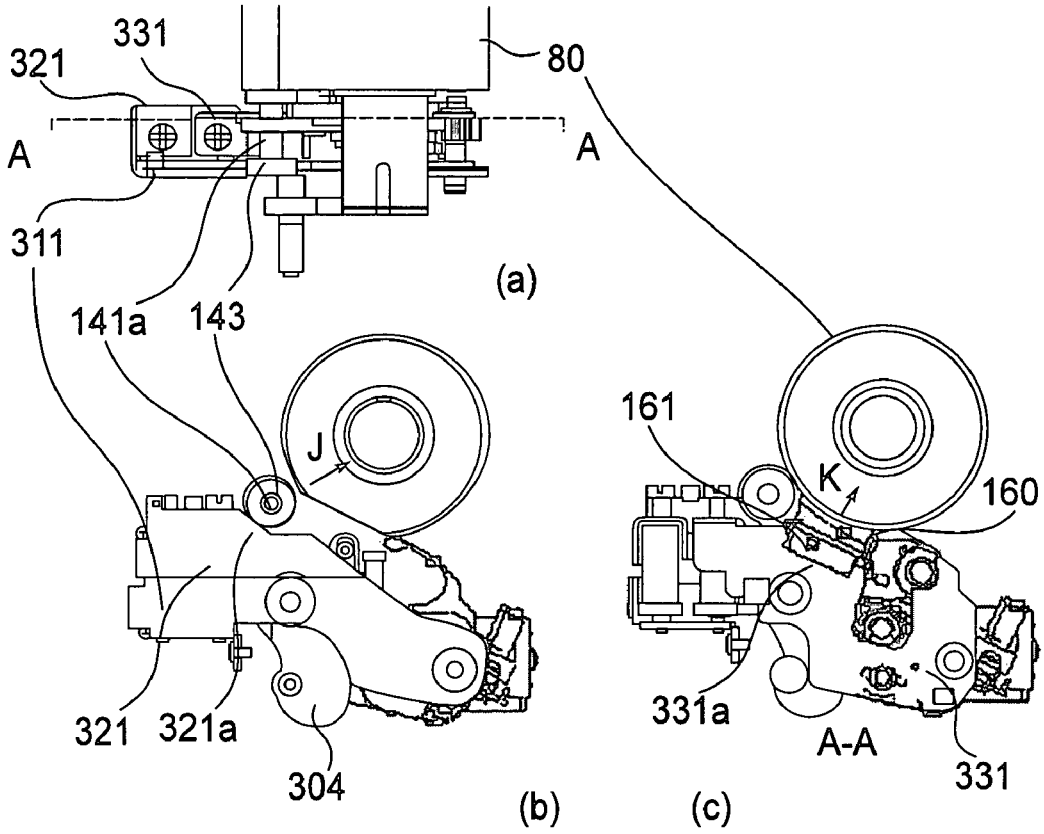
FIG. 9 is a schematic drawing of the fixation belt unit, showing its structural arrangement for pressure application.

FIG. 9(*a*) is a schematic top view of the fixing apparatus 5, and FIG. 9(*b*) is a schematic front view of the fixing apparatus 5. FIG. 9(*c*) is a sectional view of the fixing apparatus, at a plane A-A in FIG. 9(*a*).

The separation roller 141 is provided with a pressure application bearing 143, which is attached to one of the lengthwise ends of the separation roller 141. The pressure application bearing 143 is in contact with the slanted surface 321*a* of the pad separation front plate 321. Here, the structure of the fixation belt unit 100 on the front side has been described. However, the structure of the fixation belt unit 100 on the rear side is the same as that on the front side. With provision of this structural arrangement, the separation roller 141 presses the fixation roller 80 in the direction indicated by an arrow mark J, which is perpendicular to the slanted surface 321*a* of the pad separation front plate 321. The pad pressing front plate 331 is provided with a groove 331*a*, in which a pad holder 161 is fitted. This structural arrangement is the same on the rear side of the drawing. With the provision of this structural arrangement, the pad portion 160 presses the fixation roller 80 in the direction indicated by an arrow mark K.

Figure 10:
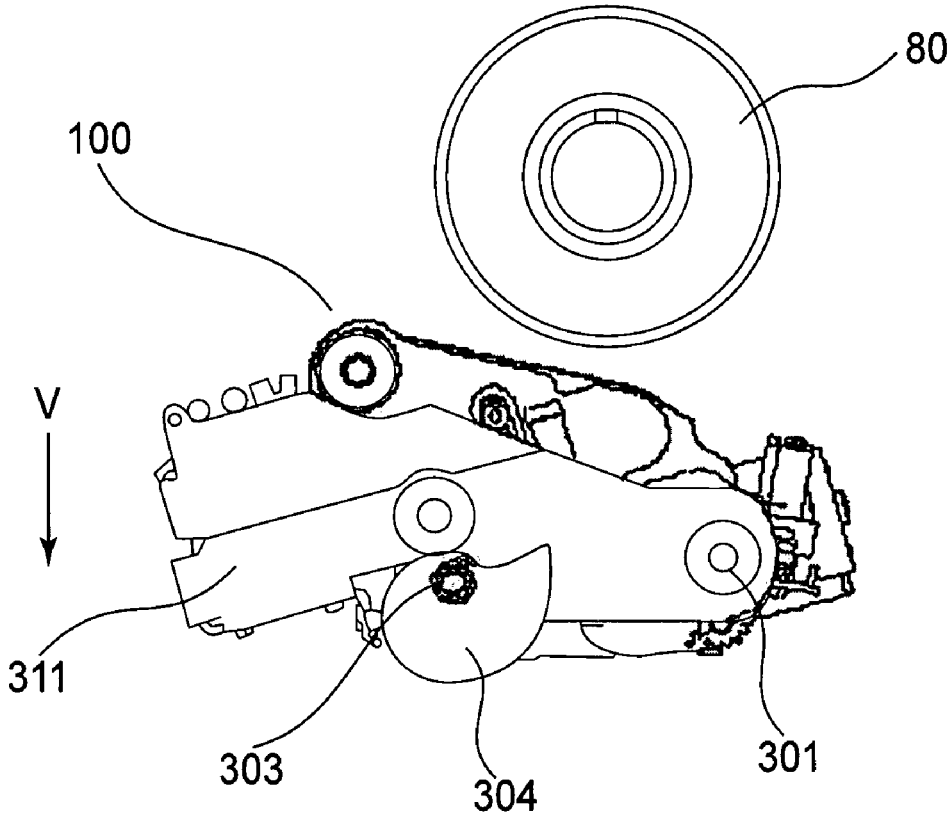
FIG. 10 is a schematic drawing of the fixation belt unit, showing its structural arrangement for pressure application.

FIG. 10 shows the fixation roller 80, and the fixation belt unit 100 which has been separated from the fixation roller.

The pressure application mechanism 300 is structured so that as the cam 304 rotates about the cam shaft 303, the pressure application front plate 311 is moved in the direction indicated by an arrow mark V, causing thereby the fixation belt unit 100 to be separated from the fixation roller 80. With the fixation belt unit 100 separated from the fixation roller 80, the paper jam or the like which sometimes occurs to the fixing apparatus can be easily dealt with.

Figure 11:
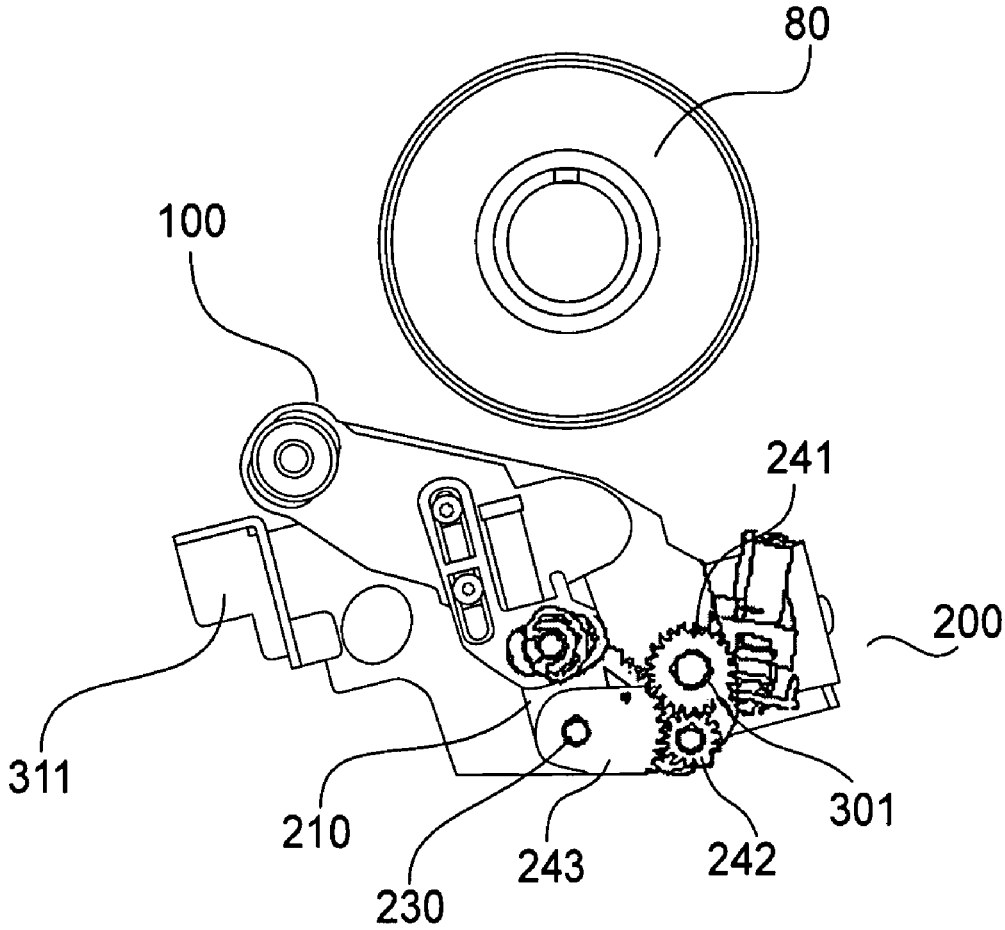
FIG. 11 is a schematic drawing of the fixation belt unit, showing its structural arrangement for pressure application.

FIG. 11 shows the state (which is the same as that shown in FIG. 6) of the pad pressing front plate 331, which has occurred as the fixation belt unit 100 was separated from the fixation roller 80. To the pad pressing front plate 331, the input gear 241, idler gear 242, and control arm 243 are attached, and further, the control shaft 230 is held by the pad pressing front and rear plates 331 and 332. Therefore, as the pad pressing front and rear plates 331 and 332 are rotated in the same manner by the rotation of the pressure application front and rear plates 311 and 312, respectively, the steering control portion 200 is also rotated. Therefore, even after the separation of the fixation belt unit 100 from the fixation roller 80, the steering roller portion 150 can be controlled in the same manner as the manner in which the steering roller portion 150 can be controlled while the fixation belt unit 100 is kept pressed on the fixation roller. The rotational axis of the input gear 241 coincides with the rotational axis of the rotational shaft 301. Therefore, the position of the input gear 241 is not affected by the pivoting of the pad pressing front plate 331.

Figure 12:
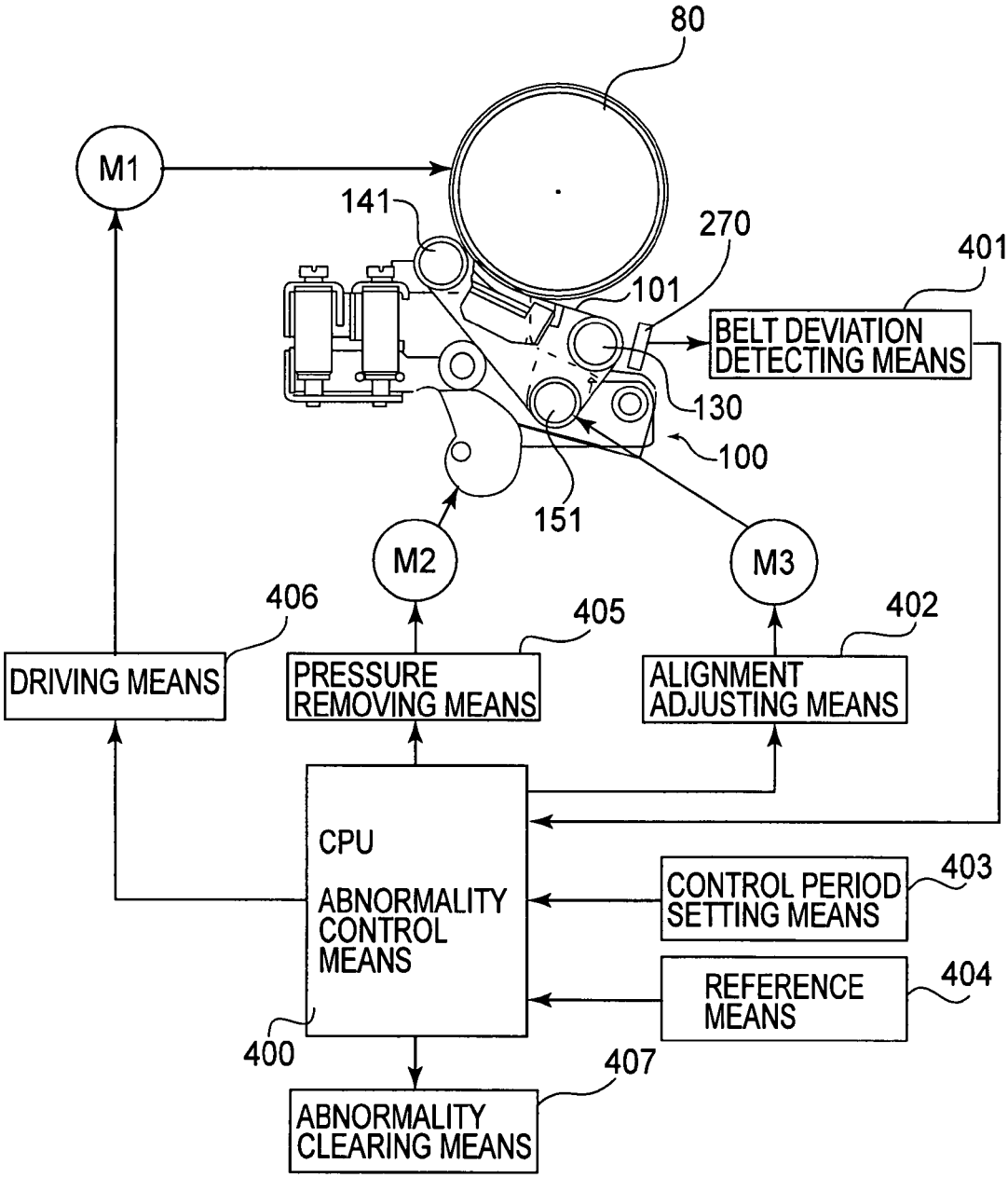
FIG. 12 is a diagrammatic drawing showing the control system of the fixation belt unit in the preferred embodiment.

FIG. 12 is a diagrammatic drawing showing the control system in this embodiment. The signals outputted by the belt deviation detecting portion 270 are inputted into a CPU as an anomaly controlling means 400, through a belt deviation detecting means 401. The anomaly controlling means 400 corrects the positional deviation of the fixation belt 101 in response to the signals from the belt deviation detecting portion 270, by transmitting driving force to the steering roller 151 through an alignment adjusting means 402 and a motor M3. The belt deviation detecting means 401 is a detecting means, whereas the alignment adjusting means 402 and motor M3 are adjusting means. Further, the anomaly controlling means 400 constitutes a first decision making means as well as a second decision making means.

When the signal from the belt deviation detecting means 270 indicates the range W3 (abnormal range) shown in FIG. 5, the anomaly controlling means 400 moves the fixation belt unit 100 in the direction to separate the fixation belt 101 from the fixation roller 80, reducing thereby the amount of the contact pressure between them, or separating them, with the use of the pressure application mechanism 300 through a pressure removing means 405 and a motor M2. The anomaly controlling means 400 also controls the rotation of the fixation roller 80 through a driving means 406 and a motor M1. Here, the pressure removing means 405 constitutes a movement controlling means, whereas the motor M2 constitutes a moving means.

Figure 13:
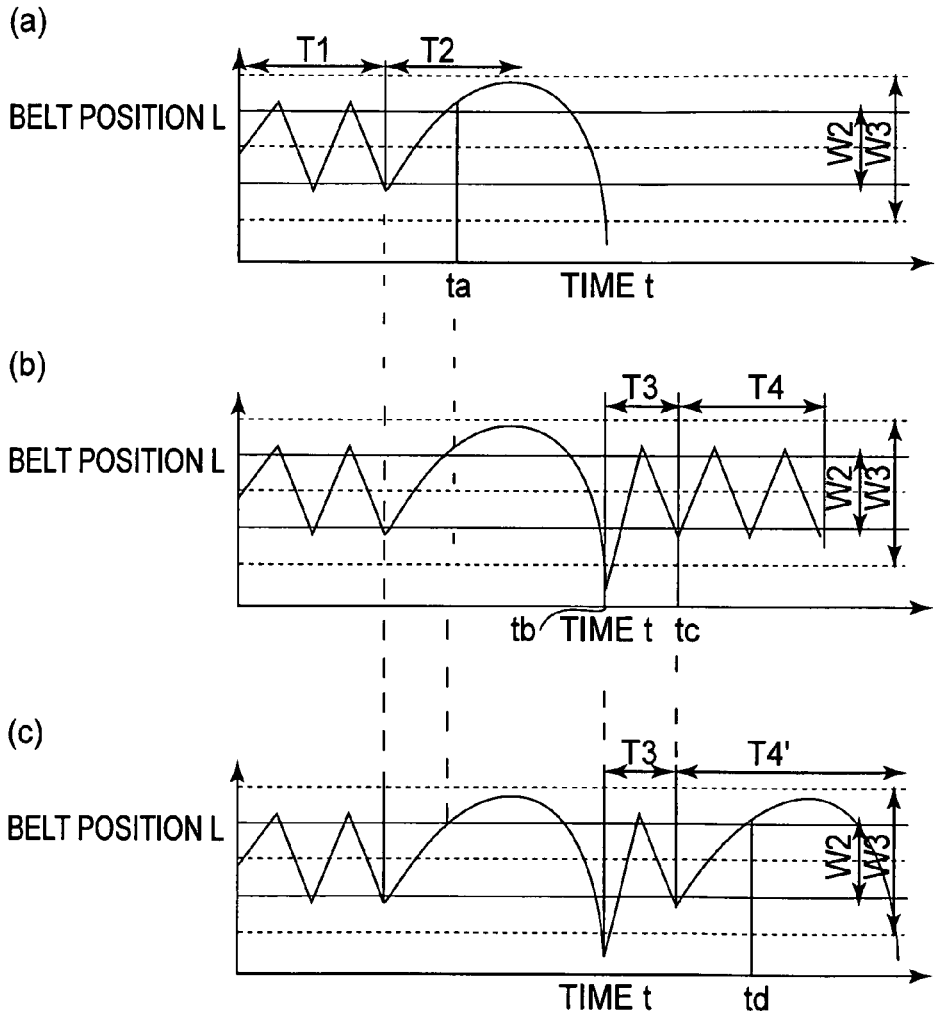
FIG. 13 is a graph showing the positions of the fixation belt of the fixation belt unit in the preferred embodiment.

FIG. 13 is a drawing for roughly describing the state of the positional deviation of the fixation belt 101: FIG. 13(*a*) is a drawing for describing the transition of the positional state of the fixation belt 101 from the well controlled state to the uncontrollable state; FIG. 13(*b*) is a drawing for describing the transition (restoration) of the positional state of the fixation belt 101 from the uncontrollable state, shown in FIG. 13(*a*), to the normal state; and FIG. 13(*c*) is a drawing for describing the transition of the positional state of the fixation belt 101 from the normal state to the uncontrollable state, after the returning to the normal state. In each drawing, the axis of ordinates represents a belt position L, and axis of abscissa represents the length t of elapsed time.

FIG. 13 shows the positions of the fixation belt 101 detected by the belt deviation detecting portion 270. As for the method for detecting the position of the fixation belt 101, the surface of the fixation belt 101 is provided with a belt position marker, and the position of the fixation belt 101 is detected by detecting the position of this belt position marker by the belt deviation detecting means 270.

Referring to FIG. 13(*a*), during the period T1, the belt position marker was moving within the range W2. This means that the fixation belt 101 was being satisfactorily controlled in terms of positional deviation, by the steering roller portion 150 which was being controlled by the belt deviation detecting portion 270 in response to the signals from the belt deviation detecting portion 270. During the period T2, that is, the period immediately after the period T1, the fixation belt unit 100 became uncontrollable, allowing the fixation belt 101 to move out of the normal range of oscillation into the abnormal range of oscillation.

In this situation, the belt deviation detecting portion 270 detected at a point ta in time that the aforementioned belt deviation detection marker moved out of the normal range W2. As a result, the anomaly controlling means 400 determined, based on the signals from the belt deviation detecting means 270, that the fixation belt 101 moved into the control anomaly range. In the case of an image forming apparatus in accordance with the prior art, when an anomaly such as this one occurs, the anomaly was detected by the main assembly of the image forming apparatus, and such steps as immediately turning off the fixing apparatus, informing an operator of the occurrence of the anomaly, etc., were carried out.

Referring to FIG. 13(*b*), as the anomaly controlling means 400 detected that the fixation belt unit was in an abnormal state of control, it outputted a pressure removing signal to the pressure removing means 405, separating thereby the fixation belt unit 100 from the fixation roller 80, at a point tb in time. As a result, the fixation belt 101 was freed from the pressure and restraint placed by the fixation roller 80 and pad portion 160, which were the major causes of the belt deviation. FIG. 13(*b*) shows that in the period T3, the fixation belt unit 100, which was in the uncontrollable state, recovered to the normal state.

Incidentally, regarding the method for restoring the fixation belt unit 100 in terms of the function of controlling the belt deviation, the structural arrangement therefor does not need to be limited to such that the fixation belt is separated from the fixation roller. For example, the fixation belt unit 100 may be structured to reduce the contact pressure between the fixation belt and fixation roller while allowing the two to remain in contact with each other. Such a structural arrangement also makes it possible to restore, in a short length of time, the fixation belt unit into its normal state in terms of the belt deviation control.

Thereafter, pressure was applied again on the fixation belt unit 100 at a point tc in time. During the period T4 in FIG. 13(*b*), it was possible to control the belt deviation, even though the fixation belt unit 100 was under the pressure. In other words, FIG. 13(*b*) shows that the anomaly which occurred during the period T2 was not recurrent, and normalcy was restored by eliminating the anomaly with the use of the pressure removing means 405.

The period T3 for determining whether or not the normal state of belt oscillation was restored after the elimination of the anomaly by the pressure removing means 405 was set by a control period setting means 403 as a time setting means shown in FIG. 12, and during this period, the anomaly controlling means 400 determined, based on the results of the detection by the belt deviation detecting portion 270, whether or not the normal belt oscillation had been restored.

FIG. 13(*c*) shows a case in which what occurred during the period T4, which followed the period T3 (in which pressure was removed in response to detection of anomaly), and which began with the re-application of the pressure, was different from what occurred in the period T4 in FIG. 13(*b*).

In the case shown in FIG. 13(*c*), as the anomaly was detected again by the belt deviation detection portion 270 at a point td in time, the anomaly controlling means 400 determined that this anomaly in the control of the positional deviation of the fixation belt 101 was recurrent, and immediately stopped the driving of the fixing apparatus with the use of the anomaly processing means 407, and informed a user of the need for maintenance.

In this case, an arrangement may be made so that if the length of time (td-dc) it takes for the belt oscillation to become abnormal after the re-application of the pressure is no more than a preset length of time, the anomaly controlling means 400 determines that the anomaly in the belt deviation control is recurrent. In this case, the referential length of time should be set to be a value which is not large enough to allow the image forming means to restart the interrupted image forming operation. Also in this case, such an arrangement may be made that if the length of time (td-dc) it takes for the belt deviation detecting portion 270 to detect the anomaly after the re-application of the pressure is greater than the abovementioned preset length of time, the fixation belt unit 100 is separated again from the fixation roller 80 by the pressure removing means 405 after the second detection of the anomaly at the point td in time.

Also referring to FIG. 13(*c*), an arrangement may be made so that if the belt deviation detecting portion 270 detects again the anomaly at the point td in time, the fixation belt unit 100 is separated from the fixation roller 80 by the pressure removing means 405 regardless of the length (td-tc) of the time. In this case, for example, an arrangement may be made so that the number of times the pressure removing means 405 separates the fixation belt unit 100 from the fixation roller 80 is counted, and if the count reaches a preset value, the anomaly controlling means 400 determines that the anomaly in the control of the positional deviation of the fixation belt 101 is recurrent.

The referential value with which the elapsed time (td-tc) is compared, or the like values, are set by the means 404 for setting referential values used for determining whether or not the positional deviation of the fixation belt 101 is abnormal; whether or not the anomaly in the control of the positional deviation of the fixation belt 101 is recurrent is determined by the anomaly controlling means 400 with reference to the preset referential value.

Further, such an arrangement is advisable that if the belt deviation detecting portion 270 detects the anomaly in the control of the positional deviation of the fixation belt 101 after the separation of the fixation belt unit 100 from the fixation roller 80 by the pressure removing means 405, the anomaly controlling means 407 determines that the control of the fixation belt 101 is abnormal, immediately stops the driving of the fixing apparatus, with the use of the anomaly processing means 407, and informs a user of the need for maintenance.

As described above, according to this embodiment of the present invention, as soon as the anomaly in the control of the positional deviation of the fixation belt 101 is detected, the anomaly in the belt deviation can be immediately dealt with, with the use of the pressure removing means. Further, by checking whether or not the anomaly in the belt deviation, which occurs while the pressure is being applied, is recurrent, not only can the service lives of the structural components of the fixation belt unit 100 be extended, but also, the image forming apparatus can be reduced in downtime.

Also according to the above described embodiment, whether or not the anomaly in the control of the belt oscillation is recurrent is efficiently determined. Therefore, the measures to be taken when there is an anomaly in the control of the belt oscillation can be optimized. Therefore, not only can the service life of the fixing apparatus (image forming apparatus) be extended, but also, the apparatus can be reduced in downtime.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 358410/2004 filed Dec. 10, 2004 which is hereby incorporated by reference.

What is claimed is:

1. An image heating apparatus comprising:

an endless belt for heating an image on a recording material in a nip;

nip forming means for cooperating with said belt to form the nip;

swing means for swinging said belt in a widthwise direction of said belt; and anomaly controlling means for reducing, when said belt is beyond a predetermined swinging range, a pressure between said belt and said nip forming means to return said belt into the predetermined swinging range.

2. An apparatus according to claim 1, further comprising measuring means for measuring time from the reduction of the pressure, wherein when said belt returns into the predetermined swinging range within a predetermined period from the reduction of the pressure, an image heating operation is resumed.

3. An apparatus according to claim 2, further comprising measuring means for measuring time from the reduction of the pressure, wherein when said belt does not return into the predetermined swinging range within a predetermined period from the reduction of the pressure, an image heating operation is prohibited.

4. An apparatus according to claim 1, wherein said swing means includes detecting means for detecting a position of said belt in the widthwise direction and reversing means for reversing a swing movement of said belt in response to an output of said detecting means.

5. An apparatus according to claim 4, further comprising a roller for rotatably supporting said belt, wherein said reversing means includes displacing means for displacing said roller to reverse a swing moving direction of said belt.

6. An apparatus according to claim 1, wherein said belt is disposed to be contacted to a side of recording material opposite the side carrying the image.

7. An apparatus according to claim 1, wherein said apparatus fixes the image on the recording material by heating the image.

8. An image forming apparatus comprising:

an image forming device for forming a toner image on a recording material;

first and second image heating members for heating the toner image on the recording material at a nip portion therebetween, at least one of said image heating members including an endless belt for heating the toner image on the recording material;

a detector which detects a position of said belt in a widthwise direction of said belt;

a rocking device for rocking said belt in the direction on the basis of the position of said belt detected by said detector so that said belt is within a predetermined zone; and a controller for separating said image heating members from each other, when said belt is beyond the predetermined zone, so that said belt returns into the predetermined zone by said rocking device.

9. An apparatus according to claim 8, further comprising a timer measuring time elapsed from a separation between said image heating members, wherein when said belt does not return into the predetermined zone within a predetermined time, said controller prohibits an image forming operation, wherein when said belt returns into the predetermined zone within the predetermined time, said controller permits the image forming operation.

10. An apparatus according to claim 8, wherein said belt is disposed to be contacted to a side of the recording material opposite the side carrying the toner image.

11. An apparatus according to claim 8, wherein said belt and nip forming device fix the toner image onto the recording material cooperatively.

12. An image forming apparatus comprising:

an image forming device for forming a toner image on a recording material;

first and second image heating members for heating the toner image on the recording material at a nip portion therebetween, at least one of said image heating members including an endless belt for heating the toner image on the recording material and a supporting member for rotatably supporting said belt;

a detector detecting a position of said belt in a widthwise direction of said belt;

a rocking device for rocking said belt in the direction by displacing a longitudinal end of said supporting member on the basis of the position of said belt detected by said detector so that said belt is within a predetermined zone; and a controller for interrupting an image forming operation for plural of recording materials when said belt is beyond the predetermined zone, and separating said image heating members from each other with an interruption of the image forming operation so that said belt returns into the predetermined zone by said rocking device, and restarting the image forming operation with return said belt into the predetermined zone.

13. An apparatus according to claim 12, further comprising a timer measuring time elapsed from a separation between said image heating members, wherein when said belt returns into the predetermined zone within a predetermined time, said controller restarts the image forming operation wherein when said belt does not return into the predetermined zone within the predetermined time, said controller prohibits the image forming operation.

14. An apparatus according to claim 12, wherein said belt is disposed to be contacted to a side of recording material opposite the side carrying the toner image.

15. An apparatus according to claim 12, wherein said image heating members fix the toner image onto the recording material cooperatively.

* * * * *

UNITED STATES PATENT AND TRADEMARK OFFICE

CERTIFICATE OF CORRECTION

PATENT NO. : 7,383,012 B2
APPLICATION NO. : 11/291925
DATED : June 3, 2008
INVENTOR(S) : Sata It is certified that error appears in the above-identified patent and that said Letters Patent is hereby corrected as shown below:

COLUMN 2:
Line 26, "pressured" should read --pressure--.

COLUMN 4:
Line 11, "FIG. 13" should read --FIG. 13, which is comprised of FIGS. 13(a, 13(b) and 13(c),--.
Line 64, "is has a" should read --has a--.

COLUMN 6:
Line 22, "FIGS. 1 3," should read --FIGS. 1 - 3,--.
Line 57, "pad pressuring" should read --the pad pressuring--.

COLUMN 7:
Line 13, "belt" should read --the belt--.
Line 14, "belt" (first occurrence) should read --the belt--.
Line 47, "it applied" should read --is applied--.

COLUMN 13:
Line 5, "plural of" should read --plural--.
Line 11, "return" should read --return of--.

Signed and Sealed this

Twentieth Day of January, 2009

JON W. DUDAS
*Director of the United States Patent and Trademark Office*